US012351987B2

(12) United States Patent
Latten

(10) Patent No.: US 12,351,987 B2
(45) Date of Patent: Jul. 8, 2025

(54) SUSTAINABLY-SOURCED, HIGH STRENGTH NON WOVEN

(71) Applicant: Fybervek Holdings LLC, Hurstbourne, KY (US)

(72) Inventor: Paul Latten, Clover, SC (US)

(73) Assignee: Fybervek Holdings LLC, Hurstbourne, KY (US)

( * ) Notice: Subject to any disclaimer, the term of this patent is extended or adjusted under 35 U.S.C. 154(b) by 337 days.

(21) Appl. No.: 17/738,173

(22) Filed: May 6, 2022

(65) Prior Publication Data

US 2022/0364307 A1 Nov. 17, 2022

Related U.S. Application Data

(60) Provisional application No. 63/185,746, filed on May 7, 2021.

(51) Int. Cl.

| | |
|---|---|
| ***D21H 15/02*** | (2006.01) |
| ***D21H 13/14*** | (2006.01) |
| ***D21H 21/18*** | (2006.01) |
| ***D21H 27/00*** | (2006.01) |

(52) U.S. Cl.

CPC ..... *D21H 5/202* (2013.01); *D21H 15/02* (2013.01); *D21H 21/18* (2013.01); *D21H 27/005* (2013.01)

(58) Field of Classification Search

CPC ..... D21H 5/202; D21H 15/02; D21H 21/18; D21H 27/005; D21H 11/12; D21H 13/02; D21H 13/10; D04H 1/26; D04H 1/28; D04H 1/425; D04H 1/4258; D04H 1/43828; D04H 1/43835; D04H 1/5412; D04H 1/067

See application file for complete search history.

(56) References Cited

U.S. PATENT DOCUMENTS

| | | | | |
|---|---|---|---|---|
| 6,762,138 | B2 * | 7/2004 | Ferreira | D04H 1/425 442/416 |
| 10,745,836 | B2 * | 8/2020 | Dutkiewicz | D04H 1/407 |
| 11,180,876 | B2 * | 11/2021 | Little | D04H 5/04 |
| 11,821,119 | B2 * | 11/2023 | Little | B01D 39/1623 |
| 2012/0234748 | A1 * | 9/2012 | Little | D04H 1/55 210/488 |

(Continued)

FOREIGN PATENT DOCUMENTS

| | | |
|---|---|---|
| EP | 0465203 A1 | 1/1992 |
| EP | 2077353 A1 | 7/2009 |

(Continued)

OTHER PUBLICATIONS

European Patent Office; International Search Report and Written Opinion issued in app. No. PCT/US2022/028004, 14 pages, dated Aug. 25, 2022.

(Continued)

*Primary Examiner* — Jose A Fortuna

(74) *Attorney, Agent, or Firm* — Gray Ice Higdon

(57) ABSTRACT

A nonwoven paper and method of manufacturing the same, where the nonwoven paper includes a thermally treated, wet-laid fiber mixture that includes a plurality of cellulosic fibers or pulp comprising about 60% to about 90% of the fiber mixture and a plurality of bicomponent binder fibers comprising about 10% to about 40% of the fiber mixture.

9 Claims, 2 Drawing Sheets

(56) References Cited

U.S. PATENT DOCUMENTS

| | | | | |
|---|---|---|---|---|
| 2020/0190739 | A1* | 6/2020 | Qin | D21H 27/005 |
| 2021/0362081 | A1* | 11/2021 | Little | D04H 1/5418 |
| 2022/0364307 | A1* | 11/2022 | Latten | D04H 1/425 |
| 2024/0133092 | A1* | 4/2024 | Little | D04H 1/55 |
| 2024/0229312 | A9* | 7/2024 | Little | B01D 39/18 |

FOREIGN PATENT DOCUMENTS

| | | | | |
|---|---|---|---|---|
| EP | 1009705 | B1 * | 8/2012 | B32B 5/022 |
| EP | 1891256 | | 8/2012 | |
| EP | 1891256 | B1 * | 8/2012 | D04H 1/425 |
| EP | 2456585 | B2 * | 12/2017 | B32B 23/02 |
| KR | 101658628 | B1 * | 10/2011 | D04H 1/58 |
| WO | WO-2012129094 | A1 * | 9/2012 | B01D 39/1623 |
| WO | 2019210230 | A1 | 10/2019 | |
| WO | WO-2022236005 | A1 * | 11/2022 | D21H 15/02 |
| WO | WO-2024097278 | A1 * | 5/2024 | |

OTHER PUBLICATIONS

Notification Concerning Transmittal of International Preliminary Report on Patentability issued for PCT Application No. PCT/US2022/028004; 11 pages; dated Nov. 16, 2023.

* cited by examiner

SUSTAINABLY-SOURCED, HIGH STRENGTH NON WOVEN

BACKGROUND OF THE INVENTION

Synthetic high-density polyethylene fibers, some of which are known under the registered trademark Tyvek® are well known in the production of various high strength, paper-like substances. Water vapor may pass through these synthetic high-density polyethylene fiber materials, but liquid may not, thus making this material ideal for a variety of uses. Some examples of the uses for this material include, but are not limited to, protecting buildings during construction (e.g. housewrap), as personal protective equipment (e.g. in medical uses), mailing envelopes, and many others. Furthermore, this material is difficult to tear, while simultaneously being easily cut with scissors or a knife. However, these synthetic high-density polyethylene fibers are ultimately a plastic, and as such, come with all the environmental impacts of a plastic, including (although not limited to) being the products of drilling and fracking.

SUMMARY

In an aspect, a nonwoven paper that includes a thermally treated, wet-laid fiber mixture is disclosed herein. The nonwoven paper includes a plurality of cellulosic fibers or pulp making up about 60% to 90% of the fiber mixture and a plurality of bicomponent binder fibers making up about 10% to about 40% of the fiber mixture.

In some implementations, the cellulosic fibers or pulp include a plurality of raw hemp fibers that comprise about 50% of the fiber mixture and a plurality of hemp pulp fibers that comprise about 20% of the fiber mixture, where the plurality of bicomponent binder fibers comprise about 30% of the fiber mixture. In some such implementations, the plurality of hemp pulp fibers is Abaca hemp pulp.

In other implementations, the cellulosic fibers or pulp include a plurality of raw hemp fibers that make up about 50% of the fiber mixture and a plurality of hemp pulp fibers that make up about 20% of the fiber mixture, where the plurality of bicomponent binder fibers make up about 30% of the fiber mixture.

In some implementations, the plurality of bicomponent binder fibers each include a polyethylene terephthalate (PET) core component and a copolyethylene sheath component. In some such implementations, the plurality of bicomponent binder fibers further includes a maleic anhydride additive.

In some implementations, the thermally treated, wet-laid fiber mixture is at least two layers. In some implementations, the thermally treated, wet-laid fiber mixture has a basis weight ranging between 25 GSM and 200 GSM.

In some implementations, the plurality of raw hemp fibers are cut to a length between about 18 mm and about 20 mm.

In some implementations, the thermally treated, wet-laid fiber mixture has a tensile strength of at least 10 pounds and an extension length of at least 1 inch. In other implementations, the thermally treated, wet-laid fiber mixture has an Elmendorf tear strength measurement of at least 230 grams force and a tear strength of at least 230 grams force. In still other implementations, the thermally treated, wet-laid fiber mixture had a thickness between 0.5 mm and 0.65 mm.

In another aspect, a nonwoven paper that includes a thermally treated, wet-laid fiber mixture is disclosed herein. The nonwoven paper including a plurality of raw hemp fibers making up about 20% to about 80% of the fiber mixture, a plurality of hemp pulp fibers making up about 0% to about 60% of the fiber mixture, and a plurality of bicomponent binder fibers making up about 10% to about 40% of the fiber mixture.

In yet another aspect, a nonwoven paper that includes a thermally treated, wet-laid fiber mixture is disclosed herein. The nonwoven paper including a plurality of raw hemp fibers making up about 50% of the fiber mixture, a plurality lyocell fibers making up about 25% to about 30% of the fiber mixture, and a plurality of bicomponent binder fibers making up about 20% to about 25% of the fiber mixture.

In still yet another aspect, a method of manufacturing a nonwoven paper is described herein, where the method includes: combining a plurality of cellulosic fibers or pulp and bicomponent binder fibers, where each of the bicomponent binder fibers includes a core component and a sheath component, forming a combination of fibers; where the plurality of cellulosic fibers or pulp make up about 60% to about 90% of the combination of fibers and the bicomponent binder fibers make up about 10% to about 40% of the combination of fibers; dispersing the combination of fibers, forming a plurality dispersed fibers; diluting the plurality of dispersed fibers forming a diluted solution, wherein the diluted solution make up about 0.1% dispersed fibers; placing the diluted solution on a screen; dewatering the diluted solution, to a dewatered solution; air drying the dewatered solution at about 350 degrees Fahrenheit to about 400 degrees Fahrenheit for about one minute to about three minutes so as to at least partially melt the sheath component of the bicomponent binder fibers, to form a dry nonwoven; and thermally treating the dry nonwoven at about 300 degrees Fahrenheit to about 350 degrees Fahrenheit.

In some implementations, the plurality of cellulosic fibers or pulp have a moisture content of about 5% to about 25%.

In some implementations, dispersing the combination of fibers additionally includes mechanically blending the combination of fibers. In other implementations, dispersing the combination of fibers further includes adding a chemical dispersant.

In some implementations, the bicomponent binder fibers further includes a maleic anhydride additive. In other implementations, the method may additionally include adding an anti-foam agent, defoaming chemical, or combination thereof to the plurality dispersed fibers. In still other implementations, the method may addition include adding a viscosity/rheology modifiers to the plurality of dispersed fibers.

In some implementations, dewatering the diluted solution may include draining water through the screen, vacuuming water through the screen, or a combination thereof to form the dewatered solution. In some implementations, dewatering the diluted solution removes about 20% to about 40% of the water from the diluted solution.

In some implementations, the method may additionally include drying and bonding the dewatered mixture in an oven at about 350 degrees Fahrenheit to about 400 degrees Fahrenheit. In some such implementations, this drying occurs for about two minutes. In other implementations, the method may additionally include rolling the dry, nonwoven prior to thermally treating the dry nonwoven.

In another aspect, a method of manufacturing a nonwoven is discussed herein, the method including: obtaining a plurality of raw hemp fibers, cellulosic fibers or pulp, and bicomponent binder fibers including a polyethylene terephthalate (PET) core component and a copolyethylene sheath component, where the plurality of raw hemp fibers have a moisture content of about 5% to about 25%; where the bicomponent binder fibers includes a maleic anhydride additive; combining the plurality of raw hemp fibers, the cellulosic fibers or pulp, and the bicomponent binder fibers, thereby forming a combination of fibers; where the plurality of raw hemp fibers make up about 50% of the combination of fibers, the cellulosic fibers or pulp make up about 20% to about 25% of the combination of fibers, and the bicomponent binder fibers make up about 20% to about 30% of the combination fibers; dispersing the combination of fibers to form a plurality of dispersed fibers; diluting the plurality of dispersed fibers with water to form a diluted solution, where the diluted solution comprises about 0.1% dispersed fibers; placing the diluted solution on a screen; dewatering the diluted solution by vacuuming to remove about 20% to about 40% of the water from the diluted solution and form a dewatered solution; air drying the dewatered solution at about 350 degrees Fahrenheit to about 400 degrees Fahrenheit for about two minutes so as to at least partially melt the copolyethylene sheath component of the bicomponent binder fibers to form a dry nonwoven; and thermally treating the dry nonwoven at about 300 degrees Fahrenheit to about 350 degrees Fahrenheit.

In some implementations, dispersing the combination of fibers additionally includes mechanically blending the combination of fibers. In other implementations, dispersing the combination of fibers may additionally include adding a chemical dispersant. In still other implementations, the method may additionally include adding an anti-foam agent, defoaming chemical, or combination thereof to the plurality dispersed fibers. In some instances, the method may additionally include adding a viscosity/rheology modifiers to the plurality of dispersed fibers.

In some instances, the method may additionally include drying and bonding the dewatered solution in an oven at about 350 degrees Fahrenheit to about 400 degrees Fahrenheit. In other instances, the method may additionally include rolling the dry nonwoven prior to thermally treating the dry nonwoven. In other instances, thermally treating the dry nonwoven may include laminating the dry nonwoven in order to melt the copolyethylene sheath component of the bicomponent binder fibers; the heat and pressure from the lamination process may strengthen and smooth the resulting nonwoven.

In some instances, the cellulosic fibers or pulp include lyocell fibers. In other instances, the cellulosic fibers or pulp include Abaca hemp pulp.

Figure 1:
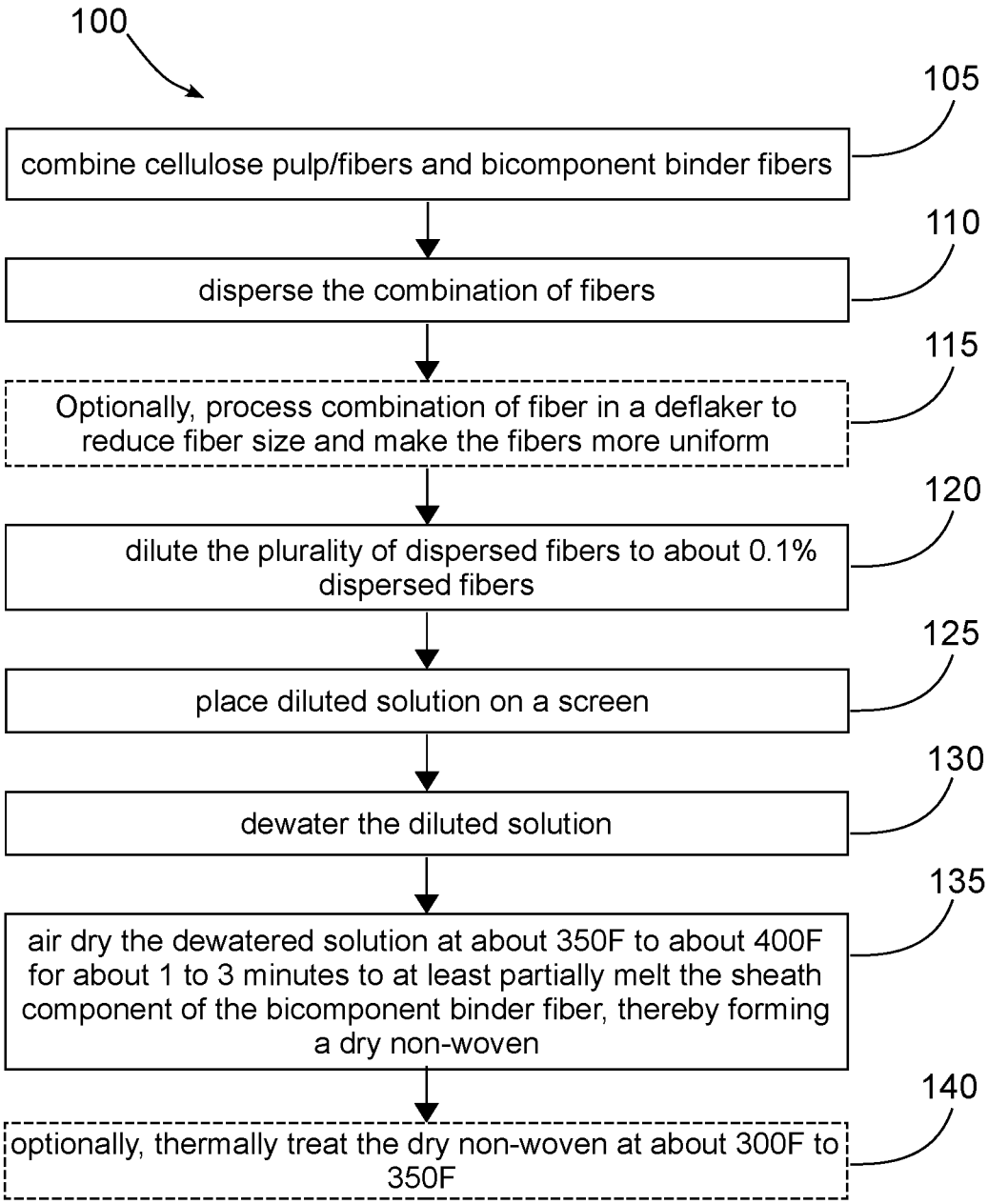
FIG. 1 is an exemplary flowchart of the method of producing a sustainably-sourced, high strength nonwoven, consistent with some embodiments described herein.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Whereas plastic production may be environmentally destructive, cellulosic pulp or fiber, may be an incredibly sustainable and ecofriendly alternative to the use of plastic in the production of nonwovens. Cellulosic pulp or fiber may be made with ethers or esters of cellulose and may be naturally found or synthetic. Some non-limiting examples of these cellulosic pulp or fiber may include: hemp pulp, wood pulp, cotton pulp, cotton fiber, bamboo fiber, lyocell fiber, rayon, etc. These cellulosic pulp or fiber may be sustainably sourced, biodegradable, and/or eco-friendly alternatives to plastics. Pulp or fiber harvested from cellulosic sources may be used in a wide range of products, including being used as a more environmentally sustainable raw material for replacement of synthetic high-density polyethylene fibers. Such a replacement fiber (e.g. a replacement for synthetic high-density polyethylene fiber) may generally be composed of raw cellulosic fibers, cellulosic pulp fibers, and/or a binder fiber.

Referring now specifically to hemp fibers as an example of cellulosic fiber, the hemp fibers may have a number of environmental benefits. For example: 1) due to retting, hemp may return more nutrients to the ground than traditional crops, which allows for healthier soil; 2) hemp may use less water than traditional crops, such as cotton; and 3) hemp thrives in small spaces, and may produce a higher yield as compared to other crops in the same space. There are primarily two kinds of fibers that are derived from the hemp plant used in industrial applications. These may be, for example, primary bast fibers and secondary bast. Primary bast fibers may be strong and similar in length to soft wood fibers; these long fibers exhibit a low lignin content, while secondary bast fibers may be more similar to hard wood fibers.

In some instances, the raw hemp fiber utilized may be these primary longer (bast) fibers. In some instances, these longer bast fibers may not be a discrete length, and rather may range in length from about 2 mm to about 20 mm. However, in other instances, the longer raw, bast fibers may be cut to a desired length prior to use. For example, in some instances, the raw hemp fibers selected for use in the process described herein may be cut to a length between about 18 mm and about 20 mm, although this is not to be understood as limiting. In some instances, cutting the raw hemp fibers to a longer length may contribute to an increased tear strength. These raw hemp fibers may comprise about 20% to about 80% of the resulting fiber combination. The raw hemp fibers may come from any suitable hemp species (e.g. any species of the *Cannabis* genus), this may include, for example *Cannabis sativa*. As the use of hemp for various industrial processes increases, various developments related to hemp species are expected, these may include, but not be limited to, cross-breading various hemp species and/or other more precise genetic modifications (e.g. gene deletions, insertions, substitutions, or the like). These developments are contemplated and within the scope of this application.

The hemp pulp fibers may also be used as a part of the fiber combination. Generally, pulp is a lignocellulosic fibrous material resulting from the separation of cellulose fibers from the hemp. This pulp may then be dissolved (for example in water) and used in the production of various nonwovens. Due to polar hydroxyl groups, cellulose may be hydrophilic; this hydrophobicity may allow the water to be attracted to the pulp fiber and thus be absorbed there between. Water absorption may soften the fiber and make the pulp (and other fibers of the mixture) more flexible. This flexibility may increase the contact area between the fibers, which may facilitate hydrogen bonding between cellulose chains as the fiber mixture dries. The hemp pulp may, in some instances, comprise about 0% to about 60% of the fiber combination. In some instances, an Abaca or Manila hemp pulp may be used, as Abaca or Manila hemp pulp may be stronger than other pulp fibers. However, this is not to be understood as limiting as other hemp pulp fibers may be used.

In some instances, lyocell fiber may be used in the fiber combination. In some instances, the lyocell fiber may be used in place of the hemp pulp described above, although this is not intended to be limiting. Lyocell fiber, like hemp pulp and other cellulosic fiber and pulp is environmentally friendly; for example, lyocell is biodegradable and composable. Lyocell is a semi-synthetic fiber, meaning it is a plant-based fiber that has also been processed with synthetic materials. The plant basis of lyocell is often wood from *eucalyptus* trees, but may also be oak, bamboo, birch, and/or the like. The source wood may then be dissolved into a wood pulp, resulting in a raw cellulose that is then processed to form lyocell fiber. This cellulosic lyocell fiber may be used in the formation of nonwovens. The lyocell fiber, similar to the hemp pulp, may be hydrophilic due to their cellulosic nature. This may allow water to be attracted to the lyocell fiber, as it would be the hemp pulp fiber, and thus be absorbed there between. Water absorption may soften the fiber and make the lyocell fibers (and other fibers of the mixture) more flexible. As described with respect to the hemp pulp, this flexibility may increase the contact area between the fibers and facilitate hydrogen bonding between cellulose chains as the fiber mixture dries. The lyocell fiber may, in some instances, comprise about 0% to about 40% of the fiber combination.

While hemp pulp and lyocell fiber are explicitly called out herein as examples of for cellulosic fiber used in a fiber mixture, this is not intended to be limiting. Other cellulosic fibers may be used alone or in combination with hemp pulp and/or lyocell to form a fiber mixture. As mentioned previously some non-limiting examples of these cellulosic pulp or fiber may include: wood pulp, cotton pulp, cotton fiber, bamboo fiber, rayon, etc.

Finally, a binder may be used in combination with the cellulosic pulp and/or fibers, for example the combination of hemp fibers and the hemp pulp, hemp fibers and lyocell, and/or just in combination with hemp fibers. Many types of binders are known in the art and may be used. Such binders may include chemical binders (either in aqueous or powder form), binder fibers, or a combination thereof. Some examples of chemical binders include, but are not limited to, polyvinyl alcohol, acrylic latex, or any other binders known in the art. Some examples of binder fibers include, but are not limited to, various bicomponent fibers. One such bicomponent fiber may be a PLA/polyethylene bicomponent fiber, where the core of the bicomponent fibers is a polylactic acid ("PLA"), and the core is surrounded by a polyethylene concentric sheath. PLA is a linear aliphatic thermoplastic polyester which is known for its sustainable nature. For example, PLA may be derived from renewable sources such as corn, and may further be compostable. Another exemplary binder fiber may be a PLA/PLA bicomponent fiber, where the two PLAs may have differing melting points, crystallinities, and/or other characteristics. PLA polymers may range from an amorphous glassy polymer to semi-crystalline or even a highly crystalline polymer. The melting temperature of PLAs may range from 130-180° C. Still another example of a binder fiber may be a polyethylene terephthalate (PET)/copolyethylene bicomponent fiber, where the PET is the core fiber and the copolyethylene forms a concentric sheath around the core.

Structure 1

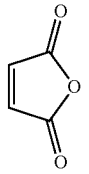

Any of the above described binders may additionally include a maleic anhydride additive, which may improve the performance of the binder. Maleic anhydride is the acid anhydride of maleic acid, and as illustrated in Structure 1 reproduced herein, includes two oxygen double bonds. Each of these oxygen double bonds may allow for covalent bonding of dissimilar materials. Bonding with something, other than itself, allows the maleic acid to strengthen the resulting structure. Furthermore, these oxygen double bonds may be capable of bonding with polyesters, hemp, pulp, lyocell, and/or any other cellulosic material used in the mixture, thus allowing for a product with increased strength.

A flowchart of an exemplary method 100 of making a nonwoven paper including cellulosic pulp and/or fiber is illustrated in FIG. 1. This flowchart is not be understood as limiting, as there may be many additional steps, some of which are described herein, that may be included. Furthermore, which of these steps may be included may be determined based on the desired characteristics of the final nonwoven product. The cellulosic pulp and/or fiber and a binder may be combined, block 105, forming a cellulosic mixture, which may then be wet-laid (blocks 110-135) to form a nonwoven material, thereby forming a web of structures bonded together by entangling the fibers. The cellulosic pulp and/or fiber may have a moisture content ranging between about 5% to about 25%. Furthermore, this collection of fibers may be prone to agglomeration, as such the first step of the wet-laid process of forming a nonwoven may be to disperse the fibers, block 110. This may include the use of mechanical dispersion, for example in the form of a blender, blend tank, mixer, deflaker, refiner, or the like, to physically separate the fibers, as illustrated in optional block 115. This process(es) may smooth and strengthen the resulting nonwoven. For example, the deflaking process may improve surface uniformity of the fibers, thus resulting in a smoother end product. As such the cellulosic pulp, cellulosic fiber, and/or binder are added to the blender, blend tank, mixer, or the like.

As a non-limiting example, the cellulosic mixture may include raw hemp fibers comprising about 20% to about 80% of the mixture, hemp pulp comprising between about 0% to about 60% of the mixture, and a binder fiber comprising between about 10% to about 40% of the mixture. In another non-limiting example, the cellulosic mixture may include raw hemp fibers comprising about 20% to about 80% of the mixture, lyocell fibers comprising between about 0% to about 60% of the mixture, and a binder fiber comprising between about 10% to about 40% of the mixture. In some instances, the percent of each of hemp fibers, hemp pulp, lyocell fibers, and/or binder used in the mixture may vary depending on the desired end use of the resulting nonwoven. As a non-limiting example, where the resulting nonwoven is to be used in package product, it may be desirable for the binder to comprises a larger proportion of the mixture, for example about 20% to about 40%. In other non-limiting examples, where the resulting nonwoven is to be used in a non-packing product, the binder may comprise a small proportion of the mixture, for example about 10% to 20%; in such instances, the content of the hemp pulp (e.g. Manila hemp pulp) and/or lyocell fiber may be increased.

In addition to mechanically dispersing the fibers, one or more chemical dispersants may also be used. As a non-limiting example, one or more surfactants may be used as a dispersant. For example, one or more surfactants in a wet-laid nonwoven may be selected based on their ionic nature (e.g. non-ionic, anionic, or cationic). In such instances, a surfactant may be selected that is compatible with the ionic nature of the fibers comprising the batch. As an example, a cellulosic fiber may be cationic, while a synthetic fiber might be anionic. Therefore, the chemistry may be tailored so as to reduce the surface tension ("wet out") of the various input fibers. Some examples of surfactant classes include, but are not limited to, various fatty acid alcohols, ethers, esters and/or block co-polymers. In some instances, foam may be present, and this foam may be a problem in formation of wet-laid nonwovens. As such, in some instances, it may be desirable to add an anti-foam emulsion agent or a defoaming chemical to the mixture.

In some instances, the fibers may have a tendency to agglomerate, twist, and/or form ropes or bundles. Thickeners or viscosity/rheology modifiers, may be added, in some instances, to reduce these tendencies. While thickening agents may have a variety of chemical compositions, they are generally water-soluble and thus capable of increasing the solution viscosity. In one example, the thickener may be ionically charged (e.g. anionic). In another example, the thickener may be acrylamide copolymer or carboxymethylcellulose (CMC). Thickeners may be viscous hydrophilic polymers that may repress the premature entanglement of the fibers. In some instances, the thickener or viscosity/rheology modifiers and surfactants may work against each other, as such it is important to select a thickener or viscosity modifier that is compatible with the dispersant selected.

Following the addition of a thickener, if used, the fiber mixture is in the form of a slurry. The slurry is diluted (typically with water) such that the solution is about 0.1% fiber, block 120, and then placed on a screen, block 125. Water is drained from the screen and/or then the screen in vacuumed, block 130. The draining and/or vacuuming, also referred to herein as "dewatering" may remove about 20% to about 40% of the water. The remaining fiber/water mixture may then be air dried and bonded through one or more ovens to remove the remaining liquid, block 135. In some instances, in particular where in a laboratory environment, this may require transfer of the partially dewatered fiber nonwoven to a heat resistant screen (e.g. a Teflon® screen). In other instances, the dewatered fiber nonwoven may remain on the same screen utilized for dewatering. The air drying in the oven(s) may occur at about 350 to about 400 degrees Fahrenheit with a residence time of about three (3) minutes or less. Where a bicomponent binder fiber is used, the temperature of the air-drying oven may be high enough to begin to melt at least a portion of the sheath of the bicomponent binder fiber. At this point in the process, the nonwoven may be strong enough to manually or mechanically handle. In some instances, the resulting nonwoven may be wound onto a roll.

Optionally, the newly-formed, rolled nonwoven may be thermally treated, for example utilizing a laminating machine, to form a finished nonwoven paper-like product, block 140. This treatment process may occur at any temperature hot enough to melt the polyethylene component of the bicomponent binder fiber, if used. For example, this may be about 300° F. to about 350° F. Melting this polyethylene outer sheath of the nonwoven fiber may further strengthen, densify, and smooth the surface of the resulting nonwoven. In some instances, a target basis weight of the resulting nonwoven may be between about 25 grams per square meter (GSM) and 200 GSM. This measurement reflects the weight of a fabric, paper, or the like, where a one meter by one meter square of the material is taken and weighed in grams.

Figure 2:
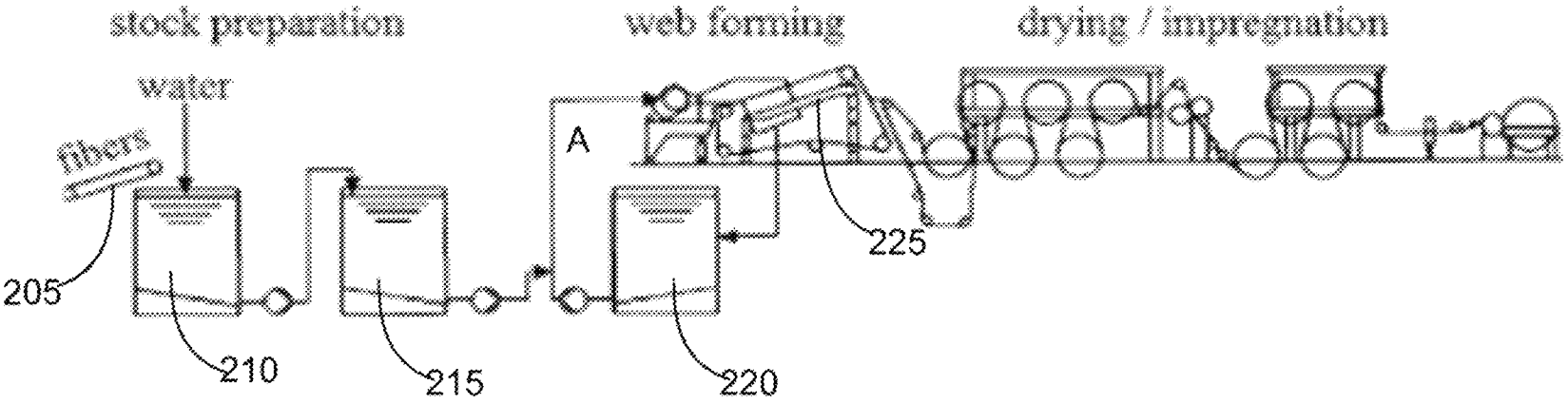
FIG. 2 is a general exemplary schematic of the machinery utilized for the process illustrated in FIG. 1, consistent with some embodiments described herein.

Turning now to FIG. 2, a general schematic of the machinery utilized in the wet-laid nonwoven process described herein is illustrated. As also described with reference to Example 5, the raw hemp fibers 205 may be, optionally processed in a deflaker (not illustrated) to reduce fiber size and make the fibers more uniform. As mentioned previously, improving the surface uniformity of the fibers may result in a smoother nonwoven. In some instances, a conical-type deflaker may be used, while in other instances, a plate-type deflaker may be used. The fibers 205 and various chemical components described herein may then be mixed in a pulper 210 to separate the fibers into a homogenous slurry. The resulting slurry may then be pumped from the pulper 210 to a stock tank 215, where additional mechanical agitation may occur. The slurry may then be pumped from the stock tank 215 to a third tank 220 (e.g. a constant level tank); this may, in some instances, supply a constant head pressure to an inlet of the stock pump 215. The stock pump 215 may, for example at arrow A, deliver a concentrated slurry into a pipe where the stock may be diluted. In some implementations, the slurry may be diluted about 4 to about 10:1 with whitewater. The diluted slurry may be then be delivered to the inclined wire forming headbox 225. The dilute slurry may then be dewatered in the headbox 225. In some instances, this may additionally include dewatering through use of a vacuum. The dewatered slurry is then dried. In the embodiment illustrated in FIG. 2 the dewater slurry is surface dried. However, this is not intended to be limiting, as an air oven may also be used to dry the dewatered slurry. Furthermore, in instances where an air oven is utilized for drying, the air oven may complete the drying and also begin the melting/bonding the bicomponent sheath polymer (if used), as described herein.

The resulting nonwoven may be used in a variety of applications, including but not limited to, protecting buildings during construction (e.g. housewrap), as personal protective equipment (e.g. in medical uses), mailing envelopes, and many others. The nonwoven from the processes described herein may be particularly suited for more paper-like applications, such as envelopes, mailers, or the like, but it not so limited.

EXAMPLES

Example 1

A fiber mixture was obtained comprising: 50% raw, bast hemp fibers; 20% Abaca hemp pulp fibers; and 30% core-sheath PET/copolyethylene bicomponent fiber. The raw, hemp fibers were cut to a length of about 0.25 inches. The core-sheath PET/copolyethylene bicomponent fibers are for use with a thermal bonding carded web. The melting point of the polyethylene sheath is 127° C. (260° F.). The hemp fibers, hemp pulp fibers, and binder fibers were combined and wet-laid to form a nonwoven web of structures bonded together. In the instant example, the binder fibers include a maleic anhydride (MAH) additive encapsulated therein. A dispersant and anti-foaming agent were also added to the mixture. Once dewatered and air dried, the nonwoven was thermally treated in a laminating machine. This heat treatment occurred in a laminator at a temperature of 330° F., which was high enough to melt the polyethylene sheath of the binder fiber. The laminator was run at about three meters per minute with a pressure of 100 PSI and a closed nip. This lamination process assists in densifying, strengthening, and smoothing the surface of the nonwoven. In some instances, the thermal treatment process may layer two pieces of the resulting nonwoven. The basis weight, as measured in grams per square meter, is the weight of the fabric if you take a sheet of material measuring one meter by one-meter square and weigh it in grams. The targeted basis weight of Example 1 was 150 grams per square meter (GSM). The actual basis weight of Example 1 was measured as 124 GSM.

Example 2

A fiber mixture was obtained comprising: 60% raw bast hemp fibers; 10% Abaca hemp pulp fibers; and 30% core-sheath PET/copolyethylene bicomponent fibers. The raw, hemp fibers were cut to a length of about 0.25 inches. The core-sheath PET/copolyethylene bicomponent fibers are for use with a thermal bonding carded web. The melting point of the polyethylene sheath is 127° C. (260° F.). The hemp fibers, hemp pulp fibers, and binder fibers were combined and wet-laid to form a nonwoven web of structures bonded together by entangling the fibers. In the instant example, the binder fibers include a maleic anhydride (MAH) additive encapsulated therein. A dispersant and anti-foaming agent were also added to the mixture. Once dewatered and air dried, the nonwoven was thermally treated. This treatment occurred in a laminator at a temperature of 330° F., which was high enough to melt the polyethylene sheath of the binder fiber. The laminator was run at three meters per minute with a pressure of 100 PSI and a closed nip. This lamination process assists in densifying, strengthening, and smoothing the surface of the nonwoven. In some instances, the thermal treatment process may layer two pieces of the resulting nonwoven. The targeted basis weight of Example 2 was 150 grams per square meter (GSM), while the actual basis weight of Example 2 was measured as 127 GSM.

Example 3

A fiber mixture was prepared comprising: 70% raw, bast hemp fibers and core-sheath PET/copolyethylene bicomponent fiber. The raw, hemp fibers were cut to a length of about 0.25 inches. binder fiber is a core-sheath PET/copolyethylene bicomponent fibers are for use with a thermal bonding carded web. The melting point of the polyethylene sheath is 127° C. (260° F.). The hemp fibers and binder fibers were combined and wet-laid to form a nonwoven web of structures bonded together by entangling the fibers. In the instant example, the binder fibers include a maleic anhydride (MAH) additive encapsulated therein. A dispersant and anti-foaming agent were also added to the mixture. Once dewatered and air dried, the nonwoven fiber was thermally treated. The thermal treatment occurred in a laminator at a temperature of 330° F., which was high enough to melt the polyethylene sheath of the binder fiber. The laminator was run at three meters per minute with a pressure of 100 PSI and a closed nip. This lamination process assists in densifying, strengthening, and smoothing the surface of the nonwoven. In some instances, the thermal treatment process may layer two pieces of the resulting nonwoven. The targeted basis weight of Example 3 was 150 grams per square meter (GSM), while the actual basis weight of Example 3 was measured as 127 GSM.

Example 4-Analysis of Examples 1-3

The newly formed paper-like, nonwoven material of Examples 1-3 are analyzed. As an initial matter the thickness of each example was measured. The Example 1 nonwoven was measured as having a thickness of 0.52 mm. The Example 2 nonwoven was measured as having a thickness of 0.6 mm. The Example 3 nonwoven was measured as having a thickness of 0.58 mm. The tensile strength of each of Examples 1-3 was measured in triplicate. The tensile strength was measured on an Instron® tester using TAPPI method 494. The results, presented in Table 1 below, are presented in the force (in pounds) required to break the nonwoven material.

TABLE 1

| Sample | Tensile 1 (lbs) | Tensile 2 (lbs) | Tensile 3 (lbs) | Tensile Average (lbs) | Extension Average (in) |
|---|---|---|---|---|---|
| Ex. 1 | 13.1 | 13.1 | 14.2 | 13.4 | 1.2 |
| Ex. 2 | 9.8 | 12.0 | 11.6 | 11.1 | 1.4 |
| Ex. 3 | 13.2 | 12.7 | 11.4 | 12.5 | 1.15 |

As is clear from Table 1, it is the material of Example 1 that exhibits the greatest tensile strength. The average extension of each example is also provided in Table 1. This measurement provides an indication of the amount of stretch the material has before breaking.

The Elmendorf tear measurement of each of Examples 1-3 was measured over five replicates. In the Elmendorf test, a pendulum impact tester was used to measure the amount of force required to propagate an existing slit at a fixed distance to the edge of sample being tested, along with the distance propagated. The samples to be tested were positioned in the tester and clamped in place. A cutting knife in the tester was used to create a slit in the sample which ended a specific distance from a far edge of the sample. A pendulum is released to propagate the slit through this remaining distance to the edge. The energy loss by the pendulum is used to calculate an average tearing force. This is an Elmendorf Tear test conducted via TAPPI test method 414. The average tear strength over the five replicates are presented in Table 2 below. This tear strength represents how well a material can withstand the effects of tearing, or more specifically the level of resistance for propagation and is presented in grams force.

TABLE 2

| Sample | Tear Average (Grams Force) |
|---|---|
| Ex. 1 | 291 |
| Ex. 2 | 291 |
| Ex. 3 | 238 |

Example 5

A fiber mixture was prepared comprising: 9.5 lbs (approximately 20.9% of the mixture) of raw bast hemp fibers; 23 lbs (approximately 50.5% of the mixture) of Abaca hemp pulp; and 13 lbs (approximately 28.6% of the mixture) of core-sheath PET/copolyethylene bicomponent binder fibers. The raw, bast hemp fibers were cut to a length of 18 mm. The binder fibers are for thermal bonding carded web, and were 1.7 dtex and 12 mm in length. Furthermore, the melting point of the polyethylene sheath is 127° C. (260° F.). The cut, raw, hemp fibers, Abaca hemp pulp fibers, and binder fibers were combined and wet-laid to form a nonwoven web of structures bonded together.

As an initial step, the 9.5 lbs of Abaca hemp pulp fibers were mixed with 600 gallons of freshwater and deflaked until pill free. This a process may last for at least 10 minutes using, for example, a conical-type deflaker. However, this is only exemplary and not to be understood as limiting; any type of deflaker known in the art may be utilized, including, for example, a plate-style deflaker. The 23 lbs of raw, hemp fibers were then added to the pulp/water combination, and mixed in a pulper for approximately 15 minutes. Following the mixing, 250 ml of a dispersant was added to the mixture. The binder fibers were then added and mixed in the pulper for an additional 5 minutes to mechanically disperse the combination of fibers. The mixture of raw, bast hemp fibers, Abaca pulp, and binder fibers was then further diluted by adding an additional 300 gallons of water to the mixture. After which, 100 ml of an anti-foam agent was added to the mixture, and the mixture was agitated for 10 minutes. The mixture was then placed on a screen and dewatered through gravity and vacuuming. The screen was then placed onto a conveyor and run through an oven for air drying at a temperature between 365- and 390-degrees Fahrenheit. The screen moved through the oven at eight (8) feet per minute, having a total residence time in the oven of about 2 minutes.

Once dewatered and air dried, the nonwoven was wound on to a three-inch core and thermally treated in a laminating machine at a temperature of 330° F., which was high enough to melt the polyethylene sheath of the binder fiber. The laminator was run at three meters per minute with a pressure of 100 PSI and a closed nip. This lamination process assists in densifying, strengthening, and smoothing the surface of the nonwoven. In some instances, the thermal treatment process may layer two pieces of the resulting nonwoven. The targeted basis weight of Example 5 was 150 grams per square meter (GSM). This measurement reflects the weight of a fabric, paper, or the like, where a one meter by one-meter square of the material is taken and weighed in grams. The target thickness of the final nonwoven was 36.0 mils or 0.036 inches. The described process was followed to produce four lots of a nonwoven paper-like product.

Example 6-Analysis of Examples 5

The four lots of the newly formed paper-like, nonwoven material of Example 5 were analyzed. As an initial matter the wet lay thickness of each lot was measured, the results of which are presented in Table 3. While basis weight of each lot was also measured and is also presented in Table 3.

TABLE 3

| Lot | Wet Lay Thickness (in) | Actual Basis Weight (GSM) |
|---|---|---|
| 1 | 0.0529 | 143 |
| 2 | 0.0716 | 154 |
| 3 | 0.0654 | 179 |
| 4 | 0.0629 | 148 |

The tensile strength of each lot of Example 5 was measured in each direction (both machine and cross directions) and a ratio was generated. The tensile strength was measured on an Instron® tester using TAPPI method 494. The results, presented in Table 4 below, are presented in the force (in pounds) required to break the nonwoven material.

TABLE 4

| Lot | Average Machine Direction (lbs force) | Average Cross Direction (lbs force) | Tensile Ratio |
|---|---|---|---|
| 1 | 14.7 | 10.6 | 0.719 |
| 2 | 15.1 | 13.9 | 1.085 |
| 3 | 14.2 | 14.9 | 0.951 |
| 4 | 14.2 | 14.4 | 0.986 |

Example 7

A fiber mixture was obtained comprising: 50% raw, bast hemp fibers; 20% core-sheath PET/copolyethylene bicomponent fiber; and 30% lyocell fibers. The raw, bast hemp fibers were cut to a length of about 6 mm to about 18 mm. The binder fibers are for thermal bonding carded web, were about 1 dtex to about 3 dtex, and are cut to between about 6 mm to about 12 mm in length. Further, the melting point of the polyethylene sheath on the binder fiber is 127° C. (260° F.). The lyocell fibers where about 1.3 dtex to about 1.5 dtex and about 6 mm to about 12 mm in length. The cut, raw, hemp fibers, binder fibers, and lyocell fibers were combined and wet-laid to form a nonwoven web of structures bonded together. In the instant example, the binder fibers include a maleic anhydride (MAH) additive encapsulated therein. A dispersant and anti-foaming agent were also added to the mixture. Once dewatered and air dried, the nonwoven was thermally treated in a laminating machine. This heat treatment occurred in a laminator at a temperature of 330° F., which was high enough to melt the polyethylene sheath of the binder fiber. The laminator was run at about three meters per minute with a pressure of 100 PSI and a closed nip. This lamination process assists in densifying, strengthening, and smoothing the surface of the nonwoven.

Example 8

The newly formed paper-like, nonwoven material of Example 7 is analyzed. The Elmendorf tear measurement of five samples of the Example 7 fibers were measured over five replicates. In the Elmendorf test, a pendulum impact tester was used to measure the amount of force required to propagate an existing slit at a fixed distance to the edge of sample being tested, along with the distance propagated. The samples to be tested were positioned in the tester and clamped in place. A cutting knife in the tester was used to create a slit in the sample which ended a specific distance from a far edge of the sample. A pendulum is released to propagate the slit through this remaining distance to the edge. The energy loss by the pendulum is used to calculate an average tearing force. This is an Elmendorf Tear test conducted via TAPPI test method 414. The average tear strength over the five replicates are presented in Table 5 below. This tear strength represents how well a material can withstand the effects of tearing, or more specifically the level of resistance for propagation and is presented in grams force.

TABLE 5

| Sample | Tear Average (Grams Force) |
|---|---|
| A | 660 |
| B | 554 |
| C | 551 |
| D | 696 |
| E | 507 |

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

When used in this specification and the claims as an adverb rather than a preposition, "about" means "approximately" and comprises the stated value and every value within 10% of that value; in other words, "about 100%" includes 90% and 110% and every value in between.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A nonwoven paper comprising:

a thermally treated, wet-laid fiber mixture, the mixture including:

a plurality of cellulosic fibers or pulp comprising about 50% of the fiber mixture, wherein the plurality of cellulosic fibers or pulp includes a plurality of raw hemp fibers;

a plurality of lyocell fibers comprising about 25% to about 30% of the fiber mixture;

a plurality of bicomponent binder fibers comprising about 20% to about 25% of the fiber mixture;

wherein the thermally treated, wet-laid fiber mixture has an Elmendorf tear strength measurement of at least 230 grams force and a tear strength of at least 230 grams force.

2. The nonwoven paper of claim 1, wherein the plurality of hemp pulp fibers is Abaca hemp pulp.

3. The nonwoven paper of claim 1, wherein the plurality of bicomponent binder fibers each include a polyethylene terephthalate (PET) core component and a copolyethylene sheath component.

4. The nonwoven paper of claim 1, wherein the plurality of bicomponent binder fibers further includes a maleic anhydride additive.

5. The nonwoven paper of claim 1, wherein the thermally treated, wet-laid fiber mixture is at least two layers.

6. The nonwoven paper of claim 1, wherein the thermally treated, wet-laid fiber mixture has a basis weight ranging between 25 GSM and 200 GSM.

7. The nonwoven paper of claim 1, wherein the plurality of raw hemp fibers are cut to a length between about 18 mm and about 20 mm.

8. The nonwoven paper of claim 1, wherein the thermally treated, wet-laid fiber mixture has a tensile strength of at least 10 pounds and an extension length of at least 1 inch.

9. The nonwoven paper of claim 1, wherein the thermally treated, wet-laid fiber mixture had a thickness between 0.5 mm and 0.65 mm.

* * * * *